US009777981B1

(12) United States Patent
Bower

(10) Patent No.: US 9,777,981 B1
(45) Date of Patent: Oct. 3, 2017

(54) BLANK-FIRING DEVICE WITH ANTI-TAMPERING FEATURES

(71) Applicant: Robert Bower, Oreland, PA (US)

(72) Inventor: Robert Bower, Oreland, PA (US)

( * ) Notice: Subject to any disclaimer, the term of this patent is extended or adjusted under 35 U.S.C. 154(b) by 0 days.

(21) Appl. No.: 15/389,848

(22) Filed: Dec. 23, 2016

(51) Int. Cl.

| | |
|---|---|
| ***A63H 5/04*** | (2006.01) |
| ***F41A 33/04*** | (2006.01) |
| ***A63H 5/00*** | (2006.01) |
| ***A63J 5/04*** | (2006.01) |

(52) U.S. Cl.
CPC ..... *F41A 33/04* (2013.01); *A63H 5/00* (2013.01); *A63J 5/04* (2013.01)

(58) Field of Classification Search
CPC ..... A63H 33/00; A63H 33/009; A63H 5/04; F41A 11/00; F41A 11/646; F41A 33/00; F41B 7/00; F41B 7/08; F42B 6/00; F42B 6/10; F41C 23/00; F41C 23/14
USPC ..... 446/473; 42/16, 75.02
See application file for complete search history.

(56) References Cited

U.S. PATENT DOCUMENTS

| | | | | |
|---|---|---|---|---|
| 2,548,622 | A | 4/1951 | Sampson | |
| 5,736,667 | A * | 4/1998 | Munostes | F41A 11/00 42/16 |
| 7,562,614 | B2 | 7/2009 | Polston | |
| 7,926,217 | B2 * | 4/2011 | McCann | F41C 23/14 42/75.02 |
| 2010/0022160 | A1 * | 1/2010 | Lee | F41B 11/646 446/473 |
| 2015/0231523 | A1 * | 8/2015 | Liao | F41A 33/00 446/473 |

* cited by examiner

*Primary Examiner* — Kien Nguyen
(74) *Attorney, Agent, or Firm* — Larson & Larson, P.A.; Justin P. Miller; Patrick A. Reid

(57) ABSTRACT

The disclosed device is based on the Thompson submachine gun. The disclosed device is specifically designed to only fire blanks, or a firearm cartridge that contains gunpowder but no bullet, shot, or projectile. Blanks can be fired in fully automatic fashion, just as a standard machine gun. Numerous features are disclosed that prevent the disclosed device from being modified to fire live cartridges. The result is a blank-firing device with the appearance of a genuine firearm, while being unable to fire live cartridges, and thus not regulated by state or federal laws, or regulations to possess, use, and/or transfer.

19 Claims, 12 Drawing Sheets

BLANK-FIRING DEVICE WITH ANTI-TAMPERING FEATURES

FIELD

This invention relates to the field of replica firearms and more particularly to a device with the appearance of a firearm, but that only fires blanks and cannot be modified to fire live cartridges.

BACKGROUND

Battle re-enactors, movie and theatrical productions, law enforcement and military training, all require the use of machine guns to provide an accurate appearance and sound signature. To ensure safety, the machineguns used must be completely safe and unable to fire "live" ammunition. In addition to being safe, the guns must be strong enough to withstand the inevitable rough handling. In particular, during battle reenactments and training of police officers and soldiers, where the guns do not receive the careful handling present on a movie set.

Until now only two options have met this need—using real machine guns that are modified to shoot blanks, or using a gun that is too fragile for "live" ammunition. As a note, within the application the term "blanks" will refer to cartridges that make noise but do not contain a projectile.

Regarding the first option, or the use of real machine guns: in nearly every situation this option is cost-prohibitive. The regulations that control ownership of machine guns have limited the supply of machine guns, causing the remaining machine guns to be very expensive.

The registration of truly original machine guns was banned in 1968. The registration of post-1968 machine guns (i.e., copies of original machine guns) was banned in 1986. No one has been able to make a firing copy of any machine gun for thirty years. And in more than thirteen states the ownership of machine guns is completely banned.

Thus, the use of genuine guns is only an option for well-funded movies.

The second option, or the use of a fragile gun, is undesirable because the resulting gun cannot stand up to the rigors of battle reenactments or police training.

What is needed is a blank-firing device that behaves as a machine gun, but cannot fire live cartridges and cannot be modified to fire live cartridges. Moreover, the blank-firing device must look, feel, and act authentic.

SUMMARY

The disclosed blank-firing device is based on the Thompson submachine gun. The disclosed device can only fire blanks, or a firearm cartridge that contains gunpowder but does not contain a bullet, shot, or other such projectile. The device can fire the blanks in fully automatic fashion, feeding from the magazine with spent cartridges being ejected from the breech just as in the original Thompson machine gun.

The disclosed device is highly authentic and indistinguishable, both in appearance and function, from an original Thompson submachine gun. The disclosed device is designed and manufactured in identical fashion to the original, using machined parts that are as strong and sturdy as the original gun. However, the gun has unique design enhancements that render the gun incapable of modification to fire "live" ammunition.

While the preferred embodiment has the appearance of a Thompson machine gun, alternative embodiments of the device can take the appearance of other firearms. For example, an MP 40, a submachine gun used by Germany during World War II.

Disclosed within are numerous features that prevent the disclosed device from being modified to fire live cartridges. The result is a blank-firing device that cannot fire live cartridges, and thus does not require a machine gun tax stamp or other governmental registration to possess and use.

The main portions of the blank-firing device are based on a Thompson submachine gun. The disclosed parts are generally as follows: The receiver of the disclosed device connects to the barrel, forming the upper section of the device. A bolt slides within the bolt pocket of the receiver, the bolt charged by a recoil spring. Prior to initial firing, the bolt is drawn back using the cocking handle, which is accessible through a slot in either the side or top of the receiver.

The trigger assembly catches and releases the bolt depending on the position of the trigger. When released, the bolt travels forward, feeds a cartridge into the chamber, allows the firing pin to contact the cartridge, thus triggering combustion of the enclosed gunpowder. The combustion gas then exits through the barrel. This process allows the blank-firing device to behave exactly like the original in all aspects but for the firing of a projectile.

While the blank-firing device is modeled on the Thompson submachine gun, numerous features exist to prevent the use of parts from a Thompson submachine gun. Additional features exist to prevent the activation or discharge of any live cartridge that is inadvertently loaded into the device.

Given that it is the motion of the bolt that causes the cartridge to discharge, discussion of the safety features will begin there.

The bolt is comprised of a body and a head. At the end of the head is depression that the cartridge is held within, with a pin to activate the primer.

In the preferred embodiment, the disclosed device uses a depression of diameter less than that of any commercially available cartridge containing a projectile. The chosen depression fits only specially designed proprietary blank cartridges. A standard Thompson submachine gun uses a .45 ACP (11.43×23 mm) (Automatic Colt Pistol) cartridge. The .45 ACP has a rim diameter, or measurement at its base, of 12.2 mm or 0.48 inches. As a result of the undersized depression, the .45 ACP cartridge does not fit within the depression of the disclosed bolt head.

As an additional safeguard, the blank-firing device may be configured to use a rimfire primed cartridge, rather than a centerfire cartridge. Given that a 0.27 rimfire firing pin will not activate a centerfire cartridge, or a 0.22 rimfire cartridge, this provides an additional safeguard against the use of standard cartridges.

In theory, the undersized bolt could be removed and replaced with a bolt from a typical Thompson submachine gun. But many changes have been made to the device to make such a bolt substitution impossible.

First, the bolt pocket within the receiver has non-standard dimensions. In particular, the front wall of the bolt pocket is thicker than that of a standard Thompson. If a standard bolt is installed within the pocket, the firing pin of the bolt is unable to reach the cartridge, and thus the primer of the cartridge cannot be activated.

The bolt of the disclosed device has a longer head that compensates for this increased wall thickness.

However, a standard bolt cannot fit within the disclosed receiver because of the narrower bolt pocket.

These dimensional changes to the bolt pocket of receiver are a result of increases in receiver wall thickness. It is plausible that a user may seek to enlarge the bolt pocket to fit a standard bolt, thus allowing live cartridges to be used. But such alteration is prevented by multiple anti-machining pins. Anti-machining pins are a tamper proofing structure that prohibits the bolt pocket from being machined to a different size.

The anti-machining pins are embedded within pockets, or areas of missing material, within various parts of the blank-firing device. For example, within the walls of the receiver around the bolt pocket.

The disclosed anti-machining pins are hardened steel dowels with a circular cross-section. The hardness of a preferred anti-machining pin is measured as C52-62 on the Rockwell Hardness Scale. With such a high hardness, the anti-machining pins cannot be cut using high-speed steel or tungsten carbide cutting tools. Only destructive methods can remove the pins.

Given that the dimensions of the bolt pocket cannot be modified without first removing the anti-machining pins, and the pins can only be removed destructively, the receiver cannot be modified to accommodate parts from other firearms. It is tamper proof.

The bolt itself is manually drawn back using the cocking handle. The cocking handle protrudes from the bolt, through a slot in the receiver. To further render the disclosed device inoperable with standard Thompson parts, the slot for the cocking handle is offset from its typical position. Specifically, the cocking handle slot is offset 0.100 inch rearward and 0.05" upward as compared to the standard location.

Thus, if a user could insert a standard bolt, the user could not fit a cocking handle to draw the bolt back to cock the device, and thus could not put the device in a position in which it could fire.

The bolt further includes two optional cavities that are filled with lead or lead shot, then closed using set screws. These cavities allow the weight of the bolt to be increased, thereby reducing the velocity of the bolt. Without a velocity reduction the cases of the fired cartridges are violently ejected, creating a potential hazard.

The disclosed changes prevent the use of any bolt other than the bolt intended for use in the disclosed device. These changes are sufficient to prevent the use of any ammunition other than the intended blanks.

Nonetheless, additional features are disclosed that further prevent the use of the disclosed device to fire live cartridges.

During assembly the barrel and receiver of the disclosed device are threaded together. This threaded connection is 7/8-16 UN thread type, whereas the standard Thompson thread is a square thread. Thus, the receivers and barrels of the disclosed device are non-interchangeable with those of a standard Thompson. Following threading, the barrel and receiver are optionally welded or brazed together, preventing the user from disassembling the parts.

With the barrel and receiver as a single piece, a user may attempt to cut the barrel from the receiver. But such cutting is prevented by additional tungsten carbide anti-machining pins. These anti-machining pins that are hidden within the barrel and receiver on either side of the connection. Thus, as above with the receiver pocket, any cutting must be destructive, and thus the resulting parts could not be used to create a functioning firearm.

The barrel of the disclosed device has additional safety features. In contrast to the barrel of a standard machine gun, the barrel of the disclosed device includes an obstruction that prevents the passage of any projectile. The obstruction of the preferred embodiment is a web-shape with three legs or sides.

The obstruction passes through substantially the entire length of the barrel. By making the obstruction substantially as long as the barrel, a user cannot cut off part of the barrel to remove the obstruction. Furthermore, by blocking the barrel along nearly its entire length, foreign objects cannot be inadvertently inserted into the barrel and later discharged when the blank cartridge releases its gas.

In alternative embodiments, the obstruction is located at the base of the barrel. In such embodiments, the user must again cut off all the barrel to remove the obstruction because cutting off only the end will leave the obstruction in place.

The web-shaped obstruction has no effect on the operation of the device. This is because firing blanks causes only the discharge of gas. The web-shaped obstruction blocks the passage of projectiles, but the cross-sectional area of the barrel is largely unblocked.

The disclosed device further includes a blank adapter. The blank adapter threads into the muzzle end of the barrel. The center of the blank adapter is open, to allow gas to pass through. But the center of the blank adapter has a smaller cross-sectional area than the remainder of the barrel. This reduced cross-sectional area restricts the flow of gas out of the barrel, creating backpressure. The backpressure provides the energy to cycle the bolt and operate the device.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
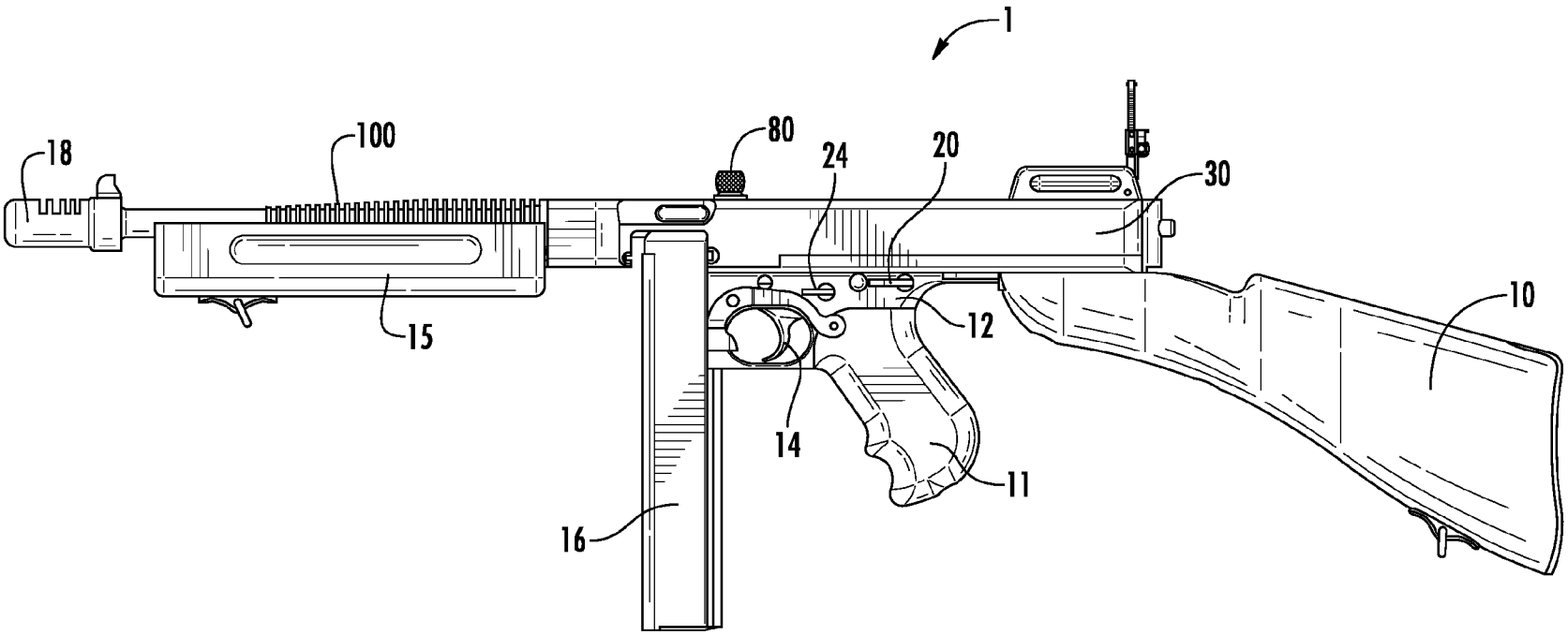
FIG. 1 illustrates a left-side view of the first embodiment.

Reference will now be made in detail to the presently preferred embodiments of the invention, examples of which are illustrated in the accompanying drawings. Throughout the following detailed description, the same reference numerals refer to the same elements in all figures.

Figure 2:
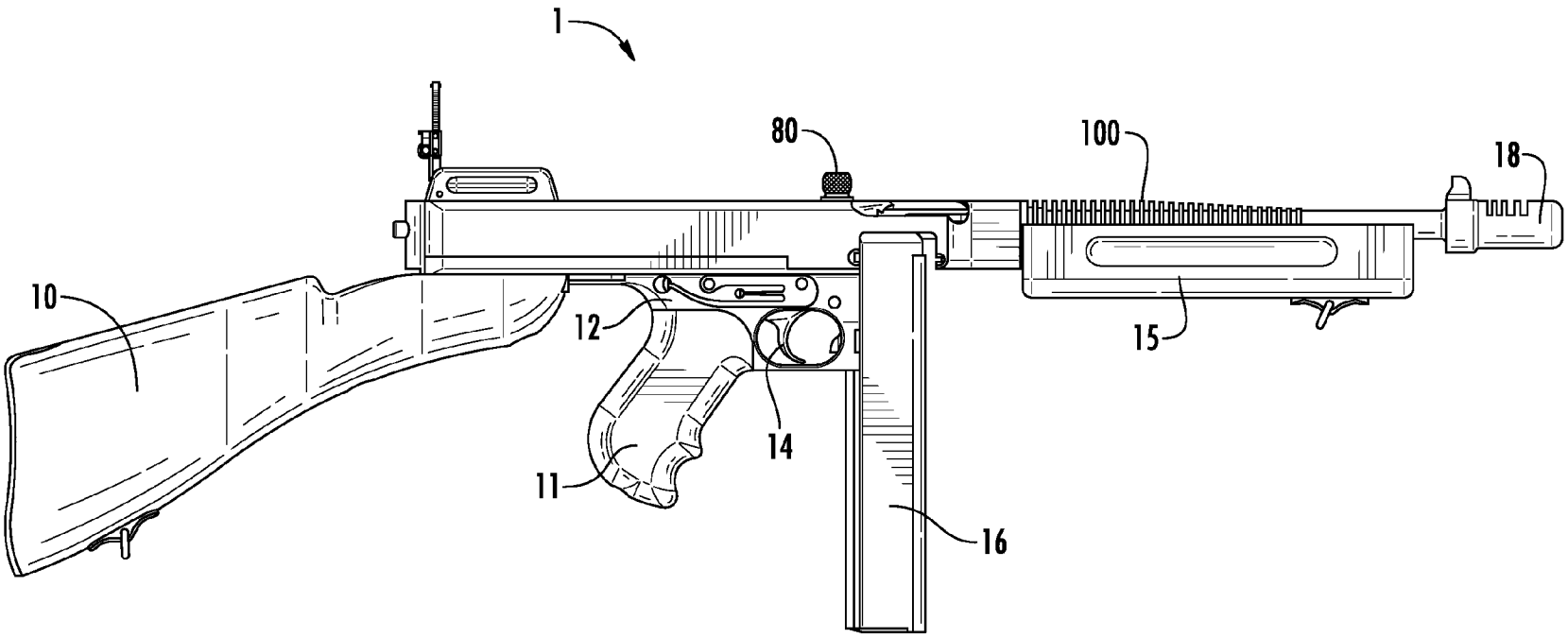
FIG. 2 illustrates a right-side view of the first embodiment.

Referring to FIGS. 1 and 2, left-side and right-side views of the first embodiment are shown, The anti-tamper blank-firing device 1 consists generally of a receiver 30 coupled to a trigger housing 12, grip 11, butt stock 10, barrel 100, and magazine 16.

Trigger housing 12 includes a trigger 14, selective fire switch 24 to toggle between single shot mode and fully automatic mode, and gun safety switch 20. In this embodiment, the cocking handle 80 protrudes through the top of the receiver 30, but in other embodiments the cocking handle 80 protrudes from the left or right side of the receiver 30.

The end of the barrel 100 is referred to as the muzzle 18. The foregrip 15 covers the grip mount 90.

Figure 3:
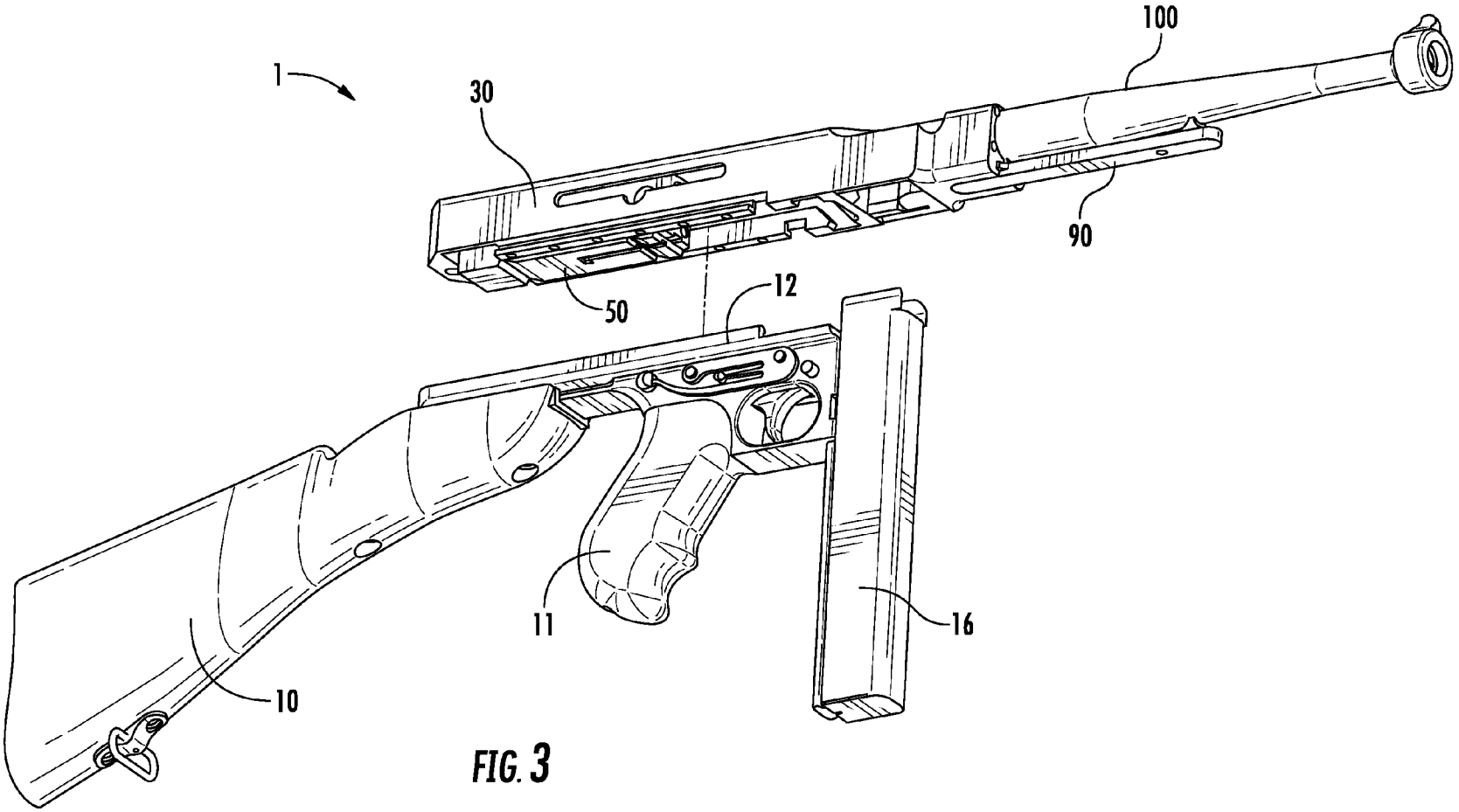
FIG. 3 illustrates an isometric view of the first embodiment with the upper half of the device separated from the lower half.

Referring to FIG. 3, an isometric view of the first embodiment is shown with the upper half of the device separated from the lower half.

The anti-tamper blank-firing device 1 readily separates along a horizontal plane between the trigger housing 12 and receiver 30. The bolt 50 is visible inside the receiver 30. The foregrip 15 is hidden, rendering the grip mount 90 visible.

Figure 4:
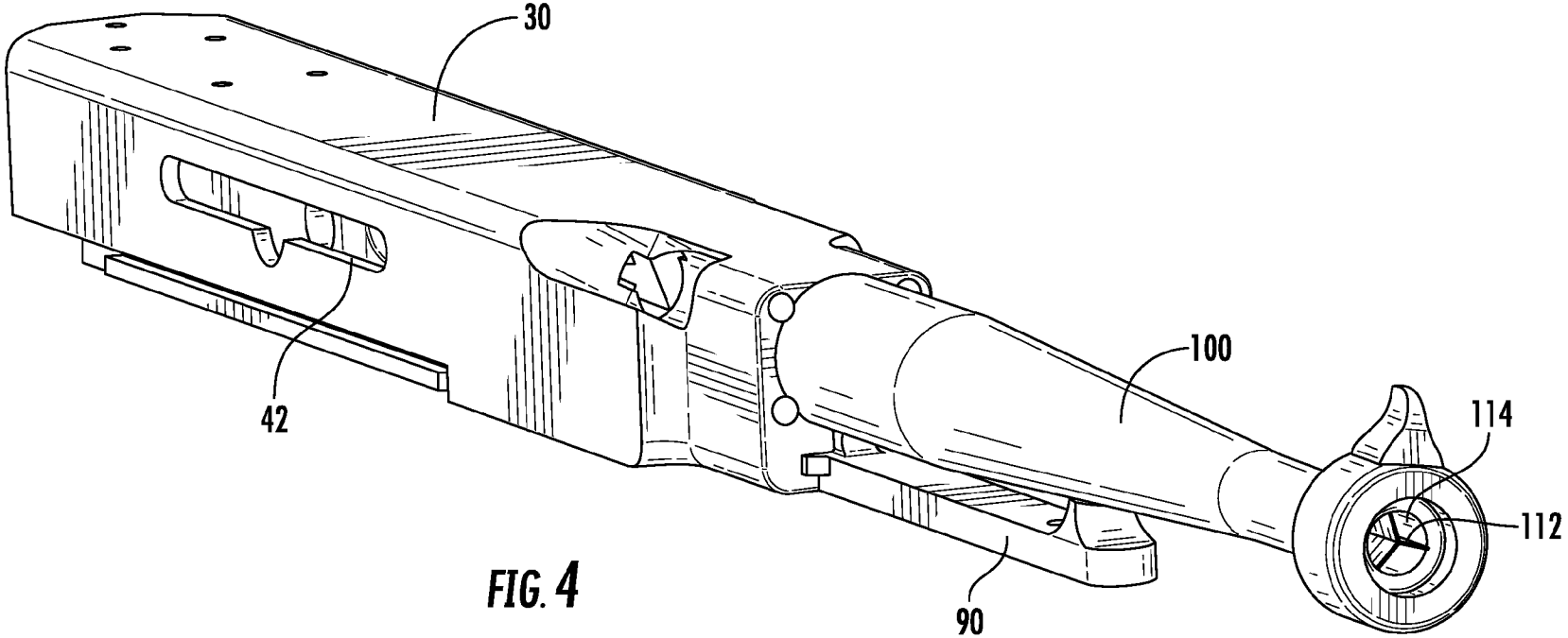
FIG. 4 illustrates a view of the upper half of the first embodiment.

Referring to FIG. 4, a view of the upper half of the first embodiment is shown. The upper half of the anti-tamper blank-firing device 1 is the focus of the features that render the device inoperable with live cartridges, and thus it will be the focus of the discussion below.

The receiver 30 is shown with cocking handle slot 42. The internal barrel web 112 is partially shown within the bore 114 of barrel 100, and is discussed further below.

Figure 5:
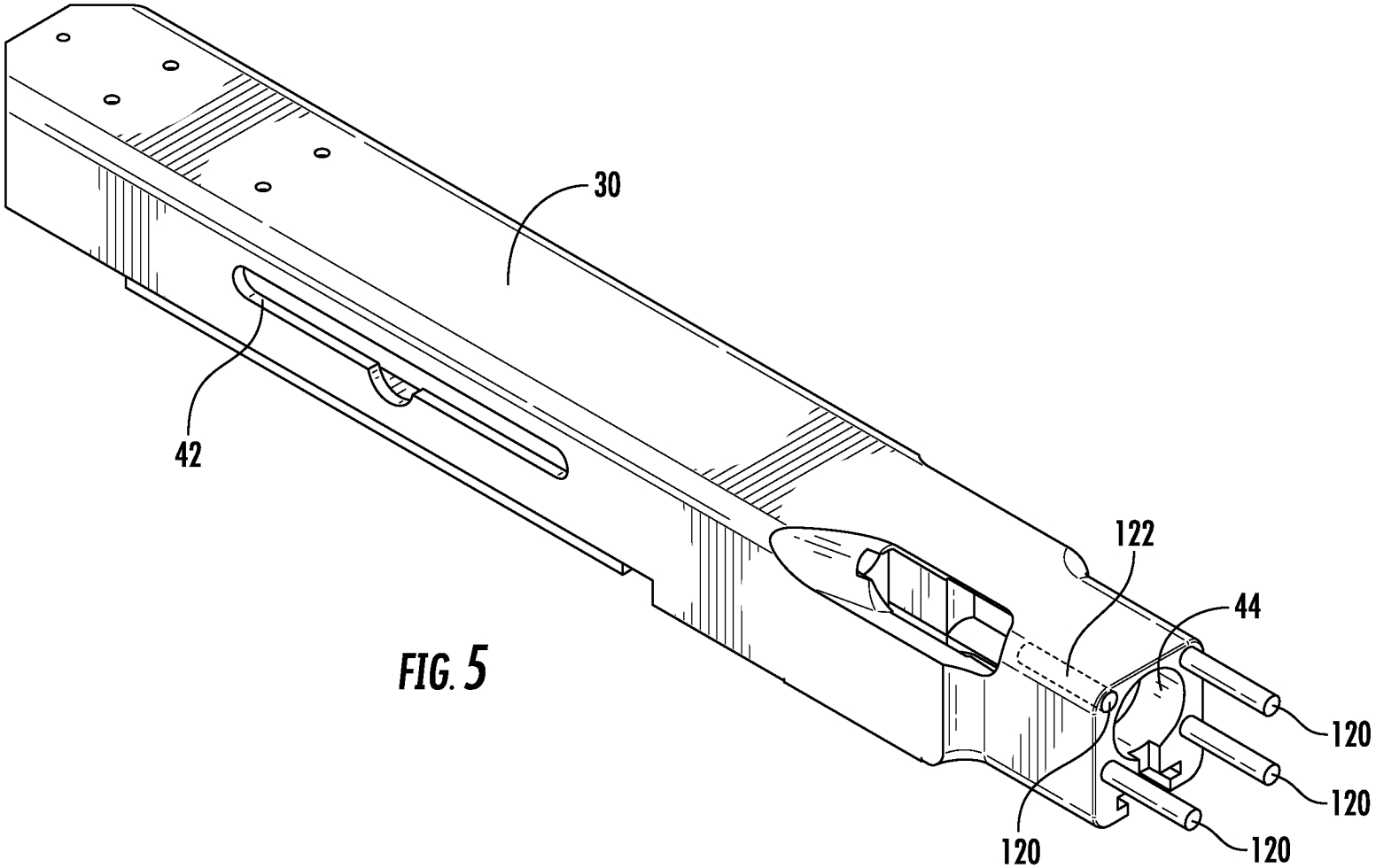
FIG. 5 illustrates an isometric view of a receiver of the first embodiment.

Referring to FIG. 5, an isometric view of a receiver of the first embodiment is shown. The first of the anti-tamper features is shown, with the anti-machining pins 120 shown. When complete, the anti-machining pins 120 lie within the anti-machining pin pockets 122. But for purposes of illustration several the anti-machining pins are shown protruding beyond the receiver 30.

Once installed, the anti-machining pins 120 block any attempts to cut the receiver 30 at the receiver barrel-engaging threads 44. Thus, the receiver 30 cannot be cut to remove the barrel 100 with its projective blocking internal barrel web 112.

Figure 6:
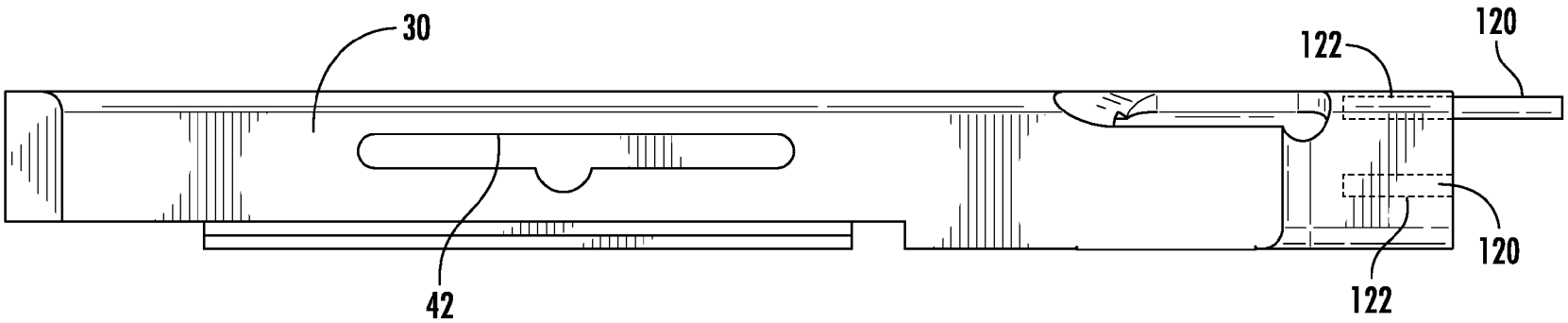
FIG. 6 illustrates a side view of the receiver of the first embodiment.

Referring to FIG. 6, a side view of the receiver of the first embodiment is shown.

The anti-machining pins 120 are again shown, with one pin protruding from its corresponding anti-machining pin pocket 122 and the other fully installed within its anti-machining pin pocket 122.

The cocking handle slot 42 is again shown. As discussed above, the cocking handle slot is offset rearward and upward as compared to the standard location, rendering the use of a standard bolt and cocking handle impossible.

Figure 7:
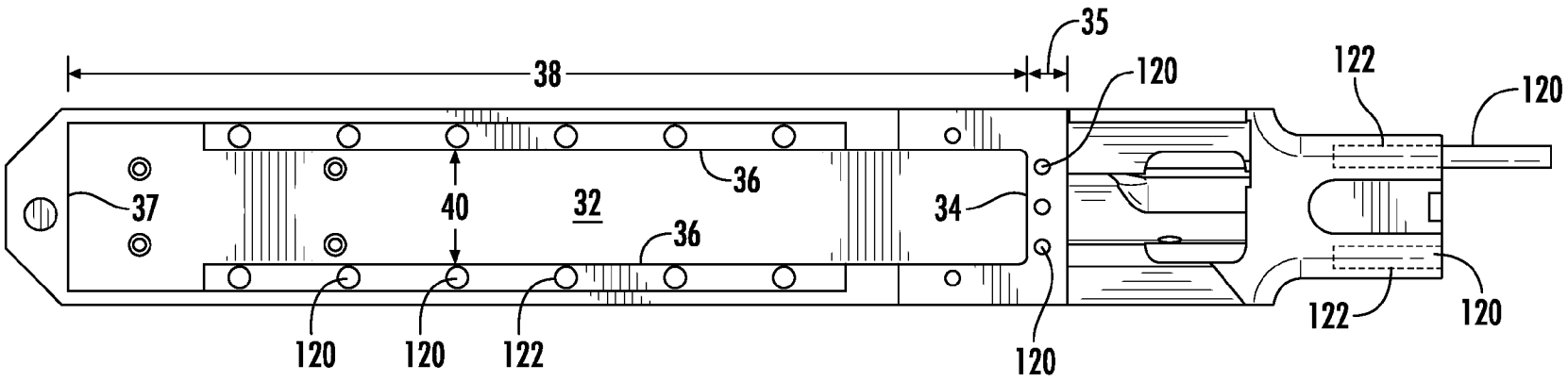
FIG. 7 illustrates a bottom view of the receiver of the first embodiment.

Referring to FIG. 7, a bottom view of the receiver of the first embodiment is shown.

Receiver 30 includes a bolt pocket 32 inside of which the bolt 50 (not shown) may slide fore and aft. The forward limit of the motion of the bolt is set by the bolt pocket front wall 34, which has a bolt pocket front wall thickness 35. In the preferred embodiment, the bolt pocket front wall thickness 35 is ⅛" greater than that of a standard Thompson. Thus, a standard bolt cannot slide far enough forward to activate the primer of a cartridge, and thus cannot fire a bullet.

The distance between the bolt pocket front wall 34 and bolt pocket rear wall 37 defines the bolt pocket length 38.

The bolt pocket side walls 36 define a bolt pocket width 40. In the preferred embodiment, the bolt pocket width 40 is 1/16" narrower than that of a standard Thompson. Because of this decreased width, a standard bolt cannot be placed within the bolt pocket 32.

Within the bolt pocket side walls 36 is a multiplicity of anti-machining pins 120 installed inside anti-machining pin pockets 122. The anti-machining pins 120 are located to prevent an increase to the bolt pocket width 40 or a decrease of the bolt pocket front wall thickness 35. Thus, the bolt pocket 32 cannot be modified to fit a standard Thomson bolt.

Figure 8:
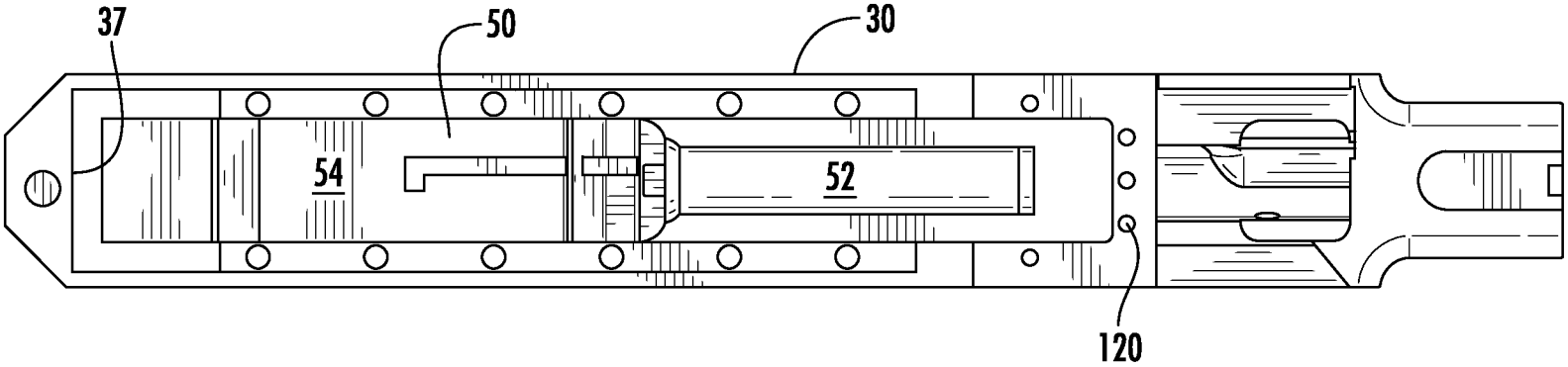
FIG. 8 illustrates a bottom view of the receiver of the first embodiment with the bolt in its rear position.

Referring to FIG. 8, a bottom view of the receiver of the first embodiment with the bolt in its rear position is shown.

The bolt 50 is shown in its rearmost position, near the bolt pocket rear wall 37. Bolt 50 includes bolt head 52 and bolt body 54. The bolt 50 does not rest against directly against the rear wall 37 because a spring retaining clip is installed between the two parts, but this part is not shown.

Figure 9:
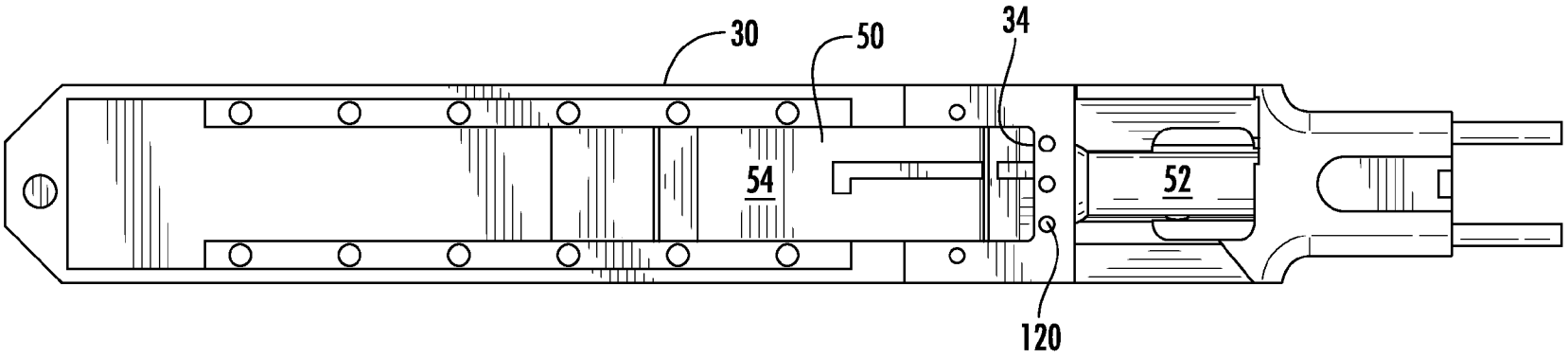
FIG. 9 illustrates a bottom view of the receiver of the first embodiment with the bolt in its front position.

Referring to FIG. 9, a bottom view of the receiver of the first embodiment with the bolt in its front position is shown.

In this position the bolt 50 is resting against the bolt pocket front wall 34. Given that the bolt pocket front wall thickness 35 is greater than that of a standard Thompson receiver, the bolt head of a standard Thompson will not reach far enough forward to activate a live cartridge. But the anti-tamper blank-firing device 1 uses a bolt head 52 that is ⅛-inch longer than a standard bolt head, thus compensating for the ⅛-inch increase in the thickness of the bolt pocket front wall 34. As a result of the increased length, the disclosed bolt 50 has a head 52 that reaches far enough to activate a blank cartridge.

Figure 10:
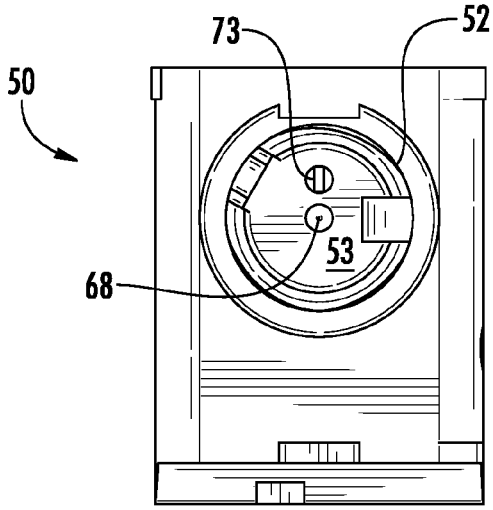
FIG. 10 illustrates a front view of a bolt of the first embodiment.

Referring to FIG. 10, a front view of a bolt of the first embodiment is shown.

The bolt head depression 53 is shown with two firing pins for purposes of illustration. A bolt head 52 of the device will only include one firing pin, the firing pin chosen to fit the desired ammunition.

The centerfire pin 68 is the more common firing pin. it is in the center of the bolt head depression 53, designed to activate the primer in the center of the cartridge. The alternative is the rimfire pin 73. The rimfire pin 73 is offset, intend to crush the rim of the 0.27 caliber primer.

The bolt head depression 53 is optionally undersized to fit only a purpose-built cartridge, thus preventing accidental firing of the .45 ACP cartridge generally used with a Thompson submachine gun.

Figure 11:
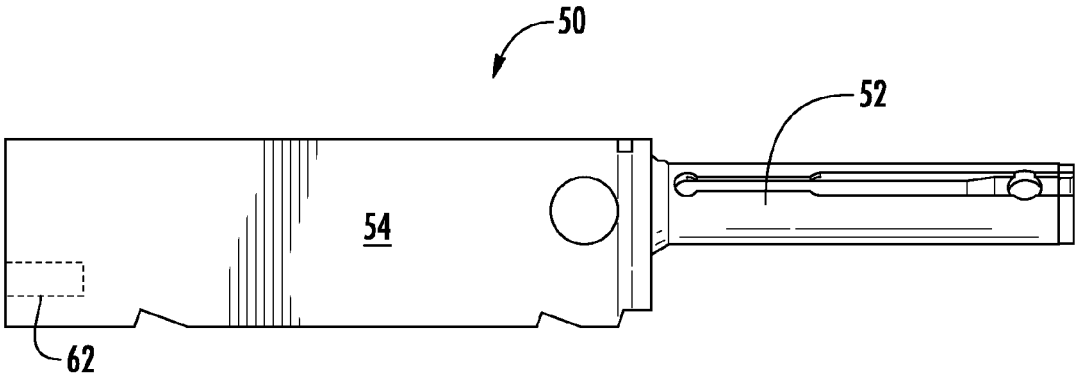
FIG. 11 illustrates a side view of the bolt of the first embodiment.

Referring to FIG. 11, a side view of the bolt of the first embodiment is shown. The bolt 50 is shown with bolt head 52 and bolt body 54. The bolt body 54 has the shape of a cuboid, or rectangular box. A single cavity 62 is shown, intended to hold lead shot to increase the weight of the bolt 50.

Figure 12:
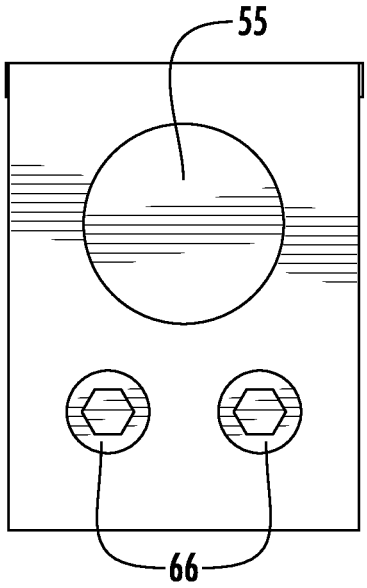
FIG. 12 illustrates a rear view of the bolt of the first embodiment.

Referring to FIG. 12, a rear view of the bolt of the first embodiment is shown. An optional bolt center cavity 55 is shown, intended to hold the recoil spring. Retention screws 66 are shown, designed to hold the lead shot within the cavities 62 of the bolt 50.

Figure 13:
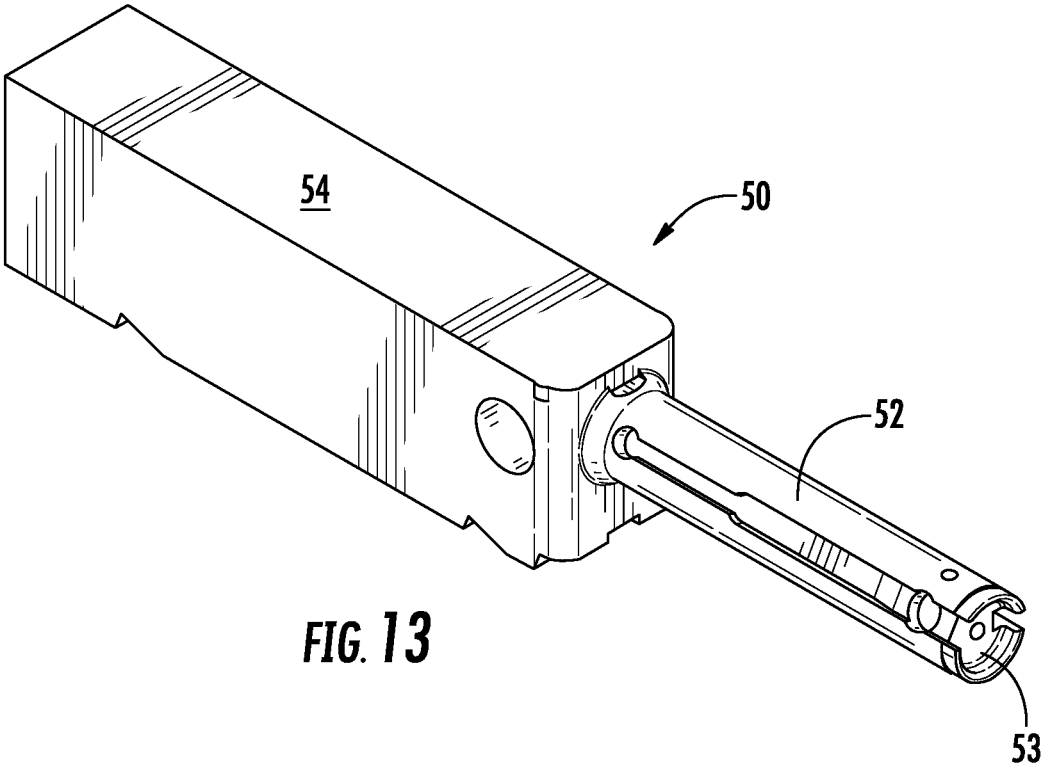
FIG. 13 illustrates an isometric view of the bolt of the first embodiment.

Referring to FIG. 13, an isometric view of the bolt of the first embodiment is shown. The bolt 50 is shown with bolt head 52 and bolt body 54.

Figure 14:
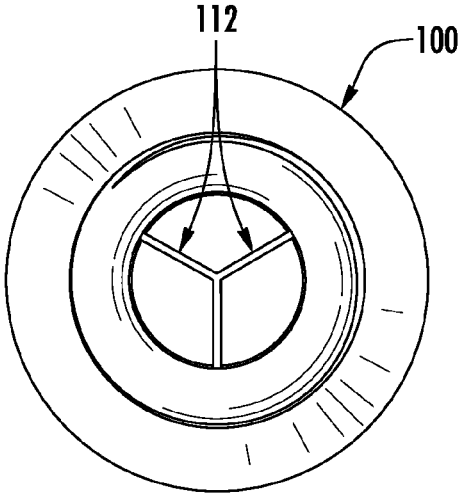
FIG. 14 illustrates a front view of a barrel of the first embodiment.

Referring to FIG. 14, a front view of a barrel of the first embodiment is shown. The barrel 100 is shown with its internal barrel web 112. The internal barrel web 112 is manufactured from the same, or similar, material as the barrel 100 itself. The internal barrel web 112 blocks any projectile from passing from the receiver into the barrel 100. The internal barrel web 112 preferably extends the length of the barrel 100, thereby preventing a user from removing the feature by cutting the barrel 100.

In the preferred embodiment the internal barrel web 112 is machined from the same stock as the barrel 100.

The barrel web 112 is shown with triangular holes, but other hole types may also be used. For example, circular holes.

Figure 15:
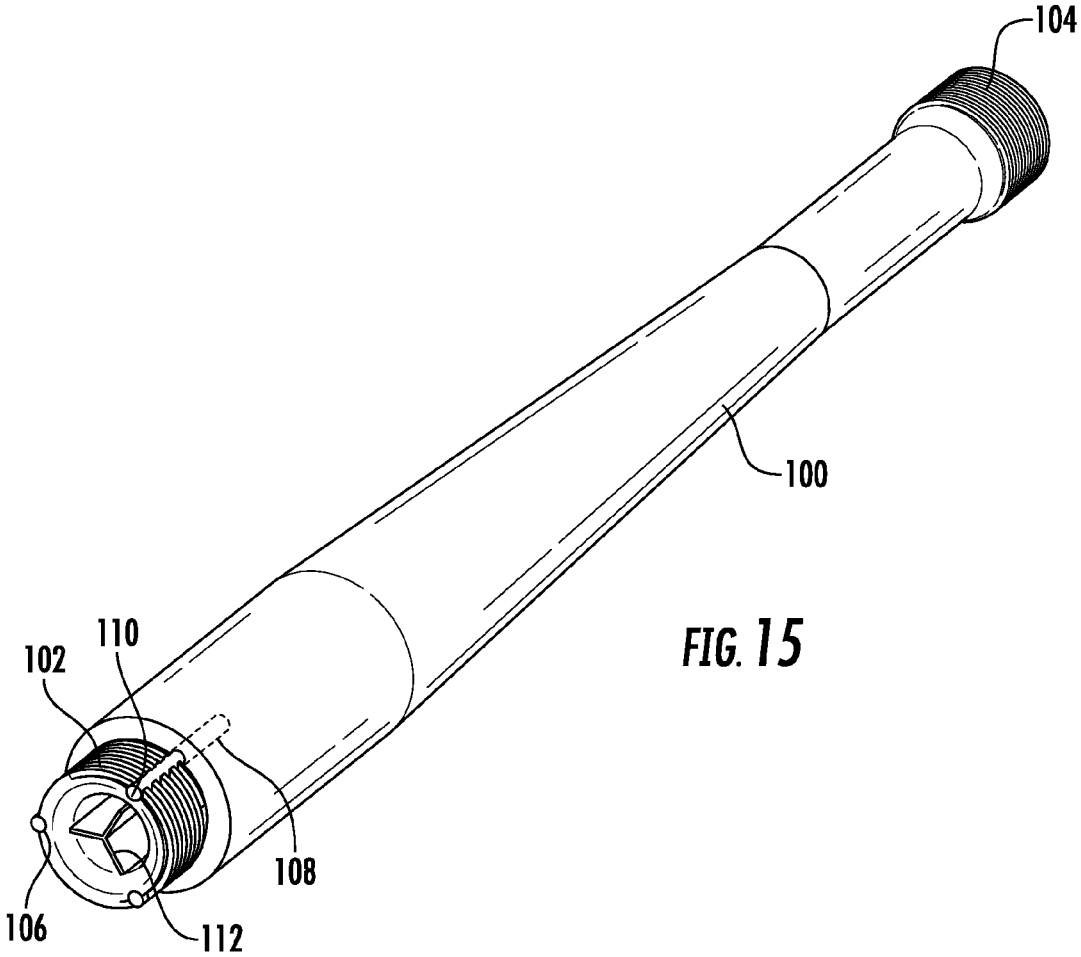
FIG. 15 illustrates an isometric view of the barrel of the first embodiment.

Referring to FIG. 15, an isometric view of the barrel of the first embodiment is shown.

The barrel 100 engages with the receiver 30 at the barrel receiver-engagement threads 102. To prevent a user from cutting the barrel 100 from the receiver 30, and thereby removing the internal barrel web 112, there are barrel anti-machining pins 106. The barrel anti-machining pins 106 are slid through the barrel pin cavity channels 110 to rest within the barrel pin cavities 108. When installed the pins 106 rest fully within the cavities 108 to avoid interference with the barrel receiver-engagement threads 102.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all its material advantages. The form herein before described being merely exemplary and explanatory embodiment thereof. It is the intention of the following claims to encompass and include such changes.

What is claimed is:

1. A device that fires blank cartridges and cannot be modified to fire live rounds, the device comprising:

a. a receiver; the receiver including
  i. a female-threaded connection;
  ii. a front wall, two side walls, and a back wall that form a bolt pocket having a length and a width;
  iii. a plurality of anti-machining pins embedded within the front wall and two side walls of the receiver;
  iv. whereby the anti-machining pins prevent alteration of the length or width of the bolt pocket;

b. a bolt, the bolt including:
  i. a bolt body with a cuboid shape;
  ii. a bolt head with a cylindrical shape;
  iii. the bold head extending from an end of the bolt body;
  iv. the bolt body slidably interfacing with the bolt pocket;

c. a barrel, the barrel including;
  i. a bore that is continuous through the barrel;
  ii. an internal barrel web that partially obstructs the bore, preventing the passage of a projectile but permitting the passage of gas;
  iii. a male-threaded connection;
    1. the male-threaded connection joined to the female-threaded connection of the receiver;

d. wherein the combination of the receiver, bolt, and barrel mounted on a lower gun half that includes a grip, trigger housing, and butt stock, thereby forming an operable device.

2. The device of claim 1, wherein the receiver and barrel and permanently welded together.

3. The device of claim 2, further comprising:

a. a bolt head depression located on an end of the bolt head;
  i. the bolt head depression including a firing pin;
  ii. the bolt head depression having an internal diameter less than 12.2 mm, thereby preventing .45 ACP cartridges from contacting the firing pin.

4. The device of claim 1, wherein the internal barrel web includes triangularly-shaped penetrations.

5. The device of claim 1, wherein the internal barrel web includes circularly-shaped penetrations.

6. The device of claim 1, further comprising:

a. a trigger housing that includes an internal firing mechanism;
  i. the trigger housing slidably affixed to the receiver;

b. a handgrip;
  i. the handgrip affixed to the trigger housing;

c. a butt stock;
  i. the butt stock affixed to the trigger housing;

d. whereby the resulting duplicates the appearance of a firearm, but is capable of firing only blank cartridges.

7. A replica firearm that cannot be modified to fire cartridges having projectiles, the replica firearm comprising:

a. a receiver slidably interfaced to a bolt;
  i. the bolt sliding within a bolt pocket;
  ii. the bolt pocket formed by two side walls, a front wall, and a back wall;

b. a barrel;
  i. the barrel including a bore for the passage of gas after firing;
  ii. the bore partially obstructed by an internal web to prevent the passage of a projectile;
  iii. the barrel connected to the receiver at a threaded connection;

c. a multiplicity of anti-machining pins;
  i. the anti-machining pins constructed from hardened steel to resist cutting;
  ii. multiple anti-machining pins embedded within the two side walls and front wall of the bolt pocket, thereby preventing any increase in size of the bolt pocket;
  iii. multiple anti-machining pins embedded within the barrel adjacent to the threaded connection;
  iv. multiple anti-machining pins embedded within the receiver adjacent to the threaded connection;

d. the replica firearm including a trigger mechanism, handgrip, and stock, to form a functioning device.

8. The replica firearm of claim 7, wherein the receiver and barrel and permanently welded together.

9. The replica firearm of claim 7, wherein the internal web of the barrel includes triangularly-shaped penetrations.

10. The replica firearm of claim 7, wherein the internal web of the barrel includes circularly-shaped penetrations.

11. The replica firearm of claim 7, further comprising:

a. a bolt head at the end of the bolt;

b. a bold head depression located on an end of the bolt head;
  i. the bolt head depression including a firing pin;
  ii. the bolt head depression having an internal diameter less than 12.2 mm, thereby preventing .45 ACP cartridges from contacting the firing pin.

12. The replica firearm of claim 7, further comprising:

a. a trigger housing that includes an internal firing mechanism;
  i. the trigger housing slidably affixed to the receiver;

b. a handgrip;
  i. the handgrip affixed to the trigger housing;

c. a butt stock;
  i. the butt stock affixed to the trigger housing;

d. whereby the resulting device is a fully-functional replica firearm, capable of firing only blank cartridges.

13. A device that permits the modification of a machinegun, thereby restricting the machinegun to fire only blank cartridges, and preventing further modification to permit firing of live cartridges, the device comprising:

a. trigger housing with trigger and grip;

b. a receiver slidably connected to the trigger housing;

c. a bolt within a bolt pocket within the receiver; the bolt pocket having a length and a width;

d. a barrel permanently affixed to an end of the receiver;

e. a butt stock affixed to the trigger housing;

f. a plurality of anti-machining pins formed from hardened steel to resist cutting;

i. one of more of the plurality of anti-machining pins placed within the receiver to prevent alteration of the length and width of the bolt pocket;

ii. one or more of the plurality of anti-machining pins placed within the barrel proximal to the receiver to prevent the barrel from being cut off the receiver;

iii. one or more of the plurality of anti-machining pins placed within the receiver proximal to the barrel to prevent the receiver from being cut to remove the barrel.

14. The device of claim 13, wherein the receiver and barrel and permanently welded together.

15. The device of claim 13, further comprising:

a. an internal web, located within a bore of the barrel;

b. the internal web permitting the passage of gases but preventing the passage of projectiles.

16. The device of claim 15, wherein the internal web of the barrel includes circularly-shaped penetrations.

17. The device of claim 16, wherein the internal web of the barrel includes circularly-shaped penetrations.

18. The device of claim 13, further comprising:

a. a bolt head at the end of the bolt;

b. a bold head depression located on an end of the bolt head;

i. the bolt head depression including a firing pin;

ii. the bolt head depression having an internal diameter less than 12.2 mm, thereby preventing .45 ACP cartridges from contacting the firing pin.

19. The device of claim 13, further comprising:

a. a trigger housing that includes an internal firing mechanism;

i. the trigger housing slidably affixed to the receiver;

b. a handgrip;

i. the handgrip affixed to the trigger housing;

c. a butt stock;

i. the butt stock affixed to the trigger housing;

d. whereby the resulting device duplicates the appearance of a genuine firearm, but is capable of firing only blank cartridges.

* * * * *